United States Patent [19]

Lewis

[11] 3,967,819

[45] July 6, 1976

[54] COMBINATION CONTAINER AND BALL GOAL WITH REFLECTOR

[76] Inventor: Jonathan Jay Lewis, 4103 Priscilla Lane, Baltimore, Md. 21208

[22] Filed: Feb. 10, 1975

[21] Appl. No.: 548,729

[52] U.S. Cl. ..... 273/103; 206/315 R; 150/52 A; 220/212; 220/324

[51] Int. Cl.[2] ..... A63B 63/02

[58] Field of Search ..... 206/315; 273/95 R, 103, 273/105 R, 105 A, 182 R; 150/52 R, 52 A; 220/212, 213, 324, 343

[56] References Cited

UNITED STATES PATENTS

| | | | |
|---|---|---|---|
| 2,027,273 | 1/1936 | Forhan | 273/103 |
| 2,060,938 | 11/1936 | Johnson | 273/103 |
| 2,521,573 | 9/1950 | Filler | 206/315 |
| 3,561,762 | 2/1971 | Russell | 273/103 |
| 3,887,181 | 6/1975 | Samaras | 273/105 R |
| 3,888,486 | 6/1975 | Sutter | 273/105 R |

*Primary Examiner*—Richard C. Pinkham
*Assistant Examiner*—Marvin Siskind
*Attorney, Agent, or Firm*—LeBlanc & Shur

[57] ABSTRACT

The combination container and ball goal includes an enclosure having side and bottom walls and an opening through its upper end. The side wall is provided with an aperture and a movable panel for opening and closing the aperture. In one form, the panel is pivoted at its lower edge to the side wall for movement between a position closing the aperture and forming a substantially continuous side wall portion with the side wall of the enclosure whereby the enclosure is adapted for use as a container and in inclined position within the enclosure for deflecting a ball received within the enclosure through its upper end toward and through the aperture when the enclosure is utilized as a ball goal. In a further form, the panel is fully removable from the enclosure thereby adapting it for use as a ball goal whereby a ball received through the upper end of the enclosure may be retrived through the aperture. When usable as a container, the panel of this latter form forms part of the substantially continuous side wall of the enclosure with the aperture fully closed by the panel.

4 Claims, 7 Drawing Figures

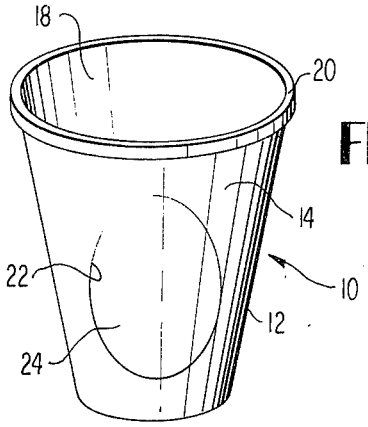
FIG. 1
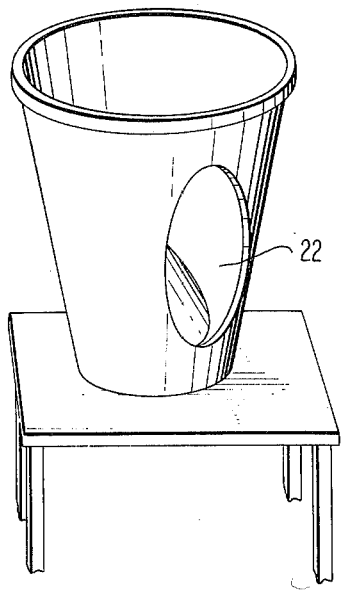
FIG. 2
FIG. 3
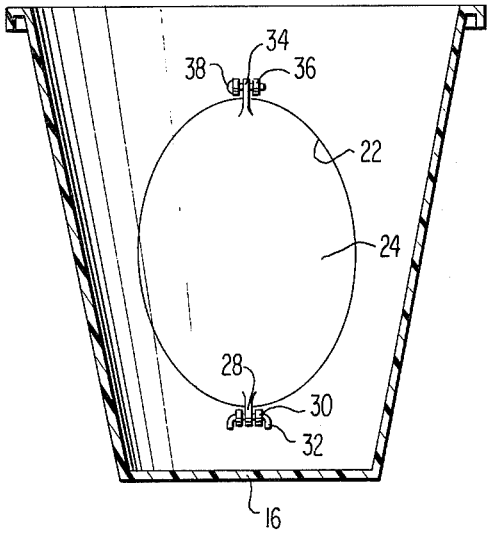
FIG. 4
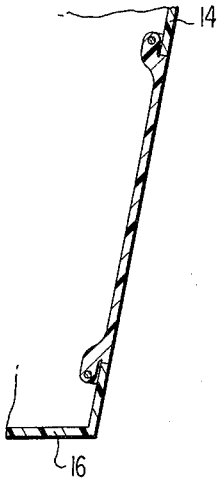
FIG. 5
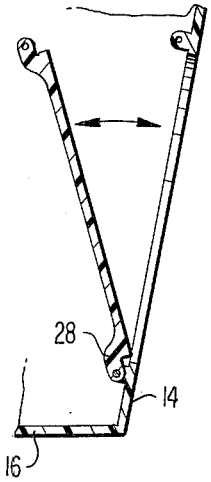
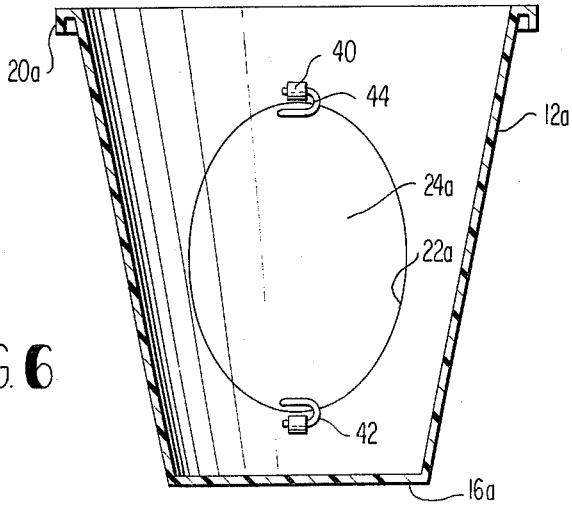
FIG. 6
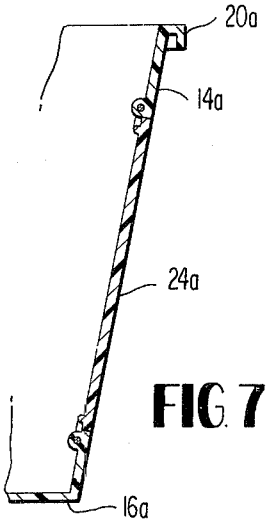
FIG. 7

COMBINATION CONTAINER AND BALL GOAL WITH REFLECTOR

The present invention relates to a combination container and ball goal and particularly relates to a portable enclosure which may be utilized as a container for example as a wastebasket or as a ball goal, for example a portable basketball goal together with novel ball return means.

Standard ball goals, for example basketball goals, are usually permanent nonportable structures conventionally supported by a pole or on the roof or side of a house or building. The permanency of this apparatus limits its use to a particular location and usually to outdoor play barring inclement weather conditions. There is thus a demand for a portable type ball goal, for example a basketball goal, which can be used indoors or outdoors without permanent securement to any supporting structure. Further, the provision of any indoor type game apparatus of the type utilizing a ball goal normally creates a problem in storing the apparatus since the apparatus is actually used only over a very short portion of its useful life and must be otherwise stored or disposed in an out-of-the-way location. There has thus also developed a need for a portable indoor or outdoor ball goal which avoids and eliminates the problems of storing the apparatus forming the goal and preferably provides another useful purpose for such apparatus when not used as a ball goal.

The present invention therefore provides a novel and improved combination container and ball goal which minimizes or eliminates many of the problems associated with prior ball goals and provides a novel and new combination container and ball goal having various advantages in construction, mode of use and result in comparison with such prior ball goals. Particularly, the present invention provides a combination container and ball goal including an enclosure having side and bottom walls and an opening at its upper end. Preferably, the side walls form a generally circular or frustoconically shaped enclosure and an aperture is provided in its side wall intermediate the upper and lower ends of the enclosure sufficiently large to permit passage of a ball. A panel is provided for selectively opening and closing the aperture. In one form of the present invention the panel is hinged at its lower end for pivotal movement between a position closing the aperture whereby the panel forms part of the substantially continuously extending side wall of the enclosure and a position inclined within the enclosure such that the panel is inclined downwardly towards the aperture. In this latter position, the panel occupies substantially the majority of the area of the enclosure at an elevation corresponding to the lower margin of the aperture whereby a ball received within the enclosure is deflected by the panel toward the aperture and outwardly of the enclosure. In another embodiment of the present invention, the panel is removable secured to and in a position flush with the side wall. In this manner, the panel forms a part of the substantially continuously extending side wall of the enclosure whereby the enclosure is adapted for use as a container. When the panel is removed, it leaves the aperture open thereby adapting the enclosure for use as a ball goal and enabling a ball to be retrieved from the lower end of the enclosure through the aperture.

The enclosure may be formed of any suitable material such as plastic. It will be appreciated that when the panel closes the aperture, in either of the embodiments hereof, the enclosure may serve as a container for example a wastebasket or a laundry basket, etc. When not used as a container and when it is desired to use the container as a ball goal, the panel is released to either pivot inwardly to a position where it serves as a deflector for a ball received within the enclosure through its open upper end for deflecting the ball outwardly through the aperture or for complete removal from the enclosure whereby a ball may be retrieved through the open aperture. The foregoing described combination container and ball goal is also portable for use either indoors or outdoors, or for placement on a floor or a table, and can be readily secured to a wall or other support simply by providing a hook. Significantly, the enclosure is readily convertable between uses as a ball goal and as a container whereby full use of the enclosure can be obtained at all times.

Accordingly, it is a primary object of the present invention to provide a novel and improved combination container and ball goal which is readily and easily adapted for use either as a container or as a ball goal.

It is still another object of the present invention to provide a novel and improved combination container and ball goal which is portable and which may be readily formed of inexpensive materials.

It is a further object of the present invention to provide a novel and improved combination container and ball goal which is readily utilized as a ball goal for either indoor or outdoor use, and can be set up as a ball goal at virtually any location, for example on a table.

It is a still further object of the present invention to provide a novel and improved combination container and ball goal which, when set up as a ball goal, has a deflector for deflecting the ball received within the enclosure outwardly of the enclosure for return to an individual player.

It is a still further object of the present invention to provide a novel and improved combination container and ball goal wherein the enclosure when used as a ball goal has an aperture providing for access within the enclosure whereby retrieval of the ball from the enclosure is readily accomplished.

These and further objects and advantages of the present invention will become more apparent upon reference to the following specification, appended claims and drawings wherein:

FIG. 1 is a perspective view of a combination container and ball goal constructed in accordance with the present invention;

FIG. 2 is a perspective view of the combination container and ball goal set up for use as a ball goal and disposed on a table;

FIG. 3 is an enlarged vertical cross sectional view of one form of the combination container and ball goal hereof;

FIGS. 4 and 5 are fragmentary vertical cross sectional views thereof illustrating a panel in a position closing an aperture through the side walls of the enclosure and in an inclined position within the enclosure, respectively;

FIG. 6 is a vertical cross-sectional view illustrating a further form of the combination container and ball goal hereof; and FIG. 7 is a fragmentary vertical cross sectional view illustrating the closure panel in position closing the aperture of the enclosure of this further form of combination container and ball goal.

Referring now to the drawings, particularly to FIG. 1, there is illustrated a combination container and ball goal constructed in accordance with the present invention and generally designated 10 and including an enclosure 12 having side and bottom walls 14 and 16, respectively. In the illustrated form of the invention, the enclosure 12 is open at its upper end at 18 and is frustoconical in shape. Enclosure 12 has a downwardly depending lip or flange 20 surrounding the upper margins thereof defining the open upper end 18. It will readily be appreciated that the enclosure 12 illustrated in FIG. 1 constitutes a container which may be used for a variety of purposes for example as a wastebasket, a laundry basket, etc.

Container 10 includes as best illustrated in FIGS. 1–3 an aperture 22 formed in its side wall and which aperture 22 lies intermediate the upper opening 18 and the bottom wall 16. A closure member or panel 24 is provided for selectively opening and closing aperture 22. As noted in FIG. 2, aperture 22 is sufficiently large to permit passage of a ball between locations within and external to enclosure 12. As noted more particularly hereinafter, when panel 24 closes aperture 22, enclosure 12 may serve as a container for the purposes noted above and, when panel 24 is removed from aperture 22, enclosure 12 may serve as a ball goal whereby a ball may be passed through the open upper end 18 of enclosure 12 and retrieved through aperture 22.

In one form of the present invention, the panel or closure member 24 is pivoted at its lower edge to the side wall 14. In this manner, panel 24 is movable between a position closing aperture 22 as illustrated in FIG. 4 and an inclined position within enclosure 12 as illustrated in FIGS. 2 and 5. Particularly, a hinge 26 may be formed between the lower end of panel 24 and the side wall 14 along the inside surface thereof. For example, an eyelet 28 is formed to project from the lower end of panel 24 for reception between a pair of eyelets 30 projecting inwardly from side wall 14, and a pin 32 is received through the eyelet 28 and 29 to hingedly connect the panel and side wall. The upper end of the panel also carries an eyelet 34 for reception between a pair of eyelets 36 projecting inwardly from the side wall 14. A pin 38 is removably received within the eyelets 34 and 36 whereby the pin secures the panel 24 in position closing aperture 22 as illustrated in FIG. 4 and is removable to enable panel 22 to pivot inwardly to an inclined position within enclosure 12 as illustrated in FIG. 2. When so inclined, the upper edge of panel 24 butts against the interior surface of the side wall opposite aperture 22 to form a downwardly inclined ramp for deflecting a ball received within enclosure 12 through opening 18 toward and for passage through aperture 22. Consequently, when panel 24 closes aperture 22 as illustrated in FIGS. 3 and 4, the enclosure 12 serves as a container, i.e. a wastebasket, laundry basket, etc. and when pin 38 is removed and the panel 24 is inclined rearwardly within the enclosure, the enclosure serves as a ball goal.

In another embodiment of the present invention, the panel 24*a* is removable in its entirety from enclosure 12*a*. In this form, a pair of eyelets 40 and 42 are provided along the interior of wall 14 adjacent the respective upper and lower extremities of aperture 22*a*. One leg of a generally U-shaped clip 44 is receivable through each eyelet 40 and 42 with the opposite leg coupled to or butting against the interior of panel 24*a*. The clips 44 may be flexible sufficiently such that panel 24*a* can be slipped into the aperture 22 with such clips retaining the panel within the aperture. Other arrangements for releasably securing the panel 24*a* within aperture 22*a* may be provided. For example, the shoulders of the panel and margins of the aperture can be bevelled or stepped to register one with the other when the panel is disposed in the opening and locking pins pivotal between positions behind and spaced from the panel may be used to releasably retain the panel in the aperture. In this embodiment, when the panel 24*a* is disposed to close the aperture 22*d* with the panel lying flush with and serving as part of the side wall of the enclosure, the latter serves as a container for the purposes stated previously. Should it be desired to use the container as a ball goal, the panel 24*a* is removed from enclosure 12 whereby access to the interior of enclosure 12 is provided through aperture 22*a*. Consequently, a ball received within enclosure 12 through the upper end opening 18 may be retrieved through aperture 22*a*.

It will be appreciated from the foregoing description that the objects of the invention are fully accomplished in that there has been provided a novel and improved inexpensive combination container and ball goal which is portable for use as a ball goal either indoors or outdoors or on a table or readily supported from a wall by means of a hook. Further, the enclosure is readily and easily convertable for use as either a container or a ball goal whereby maximum use of the apparatus is obtained. Further, the foregoing provides an enclosure which, when adapted for use as a ball goal, enables deflection of the ball received in the enclosure through the aperture for return to the individual player.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by U.S. Letters Patent is:

1. A combination container and ball goal comprising an enclosure having side and bottom walls and an opening through its upper end for passage of a ball from outside of said enclosure into said enclosure, said side wall having an aperture for passage of the ball from within the container to the outside of the container, and means carried by said enclosure for selectively opening and closing said aperture whereby said enclosure is adapted for use as a ball goal or as a container open at its upper end and bounded by said side and bottom walls, means carried by and within said enclosure for deflecting the ball received through the opening at its upper end toward said side wall aperture, said deflecting means including a side wall panel forming at least a portion of said opening and closing means, and means for releasably securing said side wall panel in position closing said side wall aperture whereby said side wall panel forms a substantially continuous part of said side wall when said enclosure is used as a container, said panel being removable from said enclosure, said securing means including a pivotal connection between said panel and said enclosure for pivotal movement of said panel between a position within said enclosure and a position closing said aperture.

2. The combination according to claim 1 wherein said securing means includes a pivotal connection between a lower edge of said panel and said side wall for pivotal movement of said panel between a position closing said aperture and forming a continuation of said side wall when said enclosure is adapted for use as a container and an inclined position within said enclosure whereby said panel serves to deflect the ball toward said aperture when said closure is used as a ball goal.

3. A combination wastepaper basket and ball goal comprising a wastepaper basket having side and bottom walls and an opening at its upper end for the reception of wastepaper and of a ball from outside of said basket into said basket, said side wall having an aperture for passage of the ball from within the basket to the outside of the basket, a removable panel in the side wall of the basket, means for releasably securing said panel in position closing said side wall, whereby said side wall panel forms a substantially continuous part of said side wall when said basket is used as a wastebasket, means for connecting said panel at its lower end to the side wall of the basket at the lower end of said aperture when said panel is moved from its wastepaper basket forming position wherein it forms a substantially continuous part of said side wall, said panel, in said removed condition, being disposed within said basket at an acute angle to the floor thereof whereby said panel serves to deflect the ball toward the aperture when said wastepaper basket is used as a ball goal.

4. The combination according to claim 3 wherein said connection includes a pivotal connection between said panel and said enclosure for pivotal movement of said panel between said position within said enclosure and a position closing said aperture.

* * * * *

UNITED STATES PATENT AND TRADEMARK OFFICE

CERTIFICATE OF CORRECTION

PATENT NO. : 3,967,819

DATED : July 9, 1976

INVENTOR(S) : Jonathan Jay Lewis

It is certified that error appears in the above-identified patent and that said Letters Patent are hereby corrected as shown below:

Title page, line 2, and Col. 1, line 2, "Reflector" should read --Deflector--.

Col. 4, line 11, "22d" should read --22a--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*